US005187321A

United States Patent [19]

Tusch

[11] Patent Number: 5,187,321

[45] Date of Patent: Feb. 16, 1993

[54] PROTECTIVE DEVICE

[75] Inventor: Klaus N. Tusch, London, England

[73] Assignee: Colebrand Limited, London, England

[21] Appl. No.: 787,824

[22] Filed: Nov. 5, 1991

[30] Foreign Application Priority Data

Nov. 7, 1990 [GB] United Kingdom ..... 9024230
Nov. 26, 1990 [GB] United Kingdom ..... 9025630

[51] Int. Cl.[5] ..... F42C 19/04
[52] U.S. Cl. ..... 102/293; 102/213
[58] Field of Search ..... 102/213, 214, 293; 244/3.16

[56] References Cited

U.S. PATENT DOCUMENTS

| | | | |
|---|---|---|---|
| 3,000,310 | 9/1961 | Power et al. | 102/214 |
| 3,336,872 | 8/1967 | Langen et al. | 102/213 |
| 3,674,227 | 7/1972 | Jacobson et al. | 102/293 |
| 3,747,530 | 7/1973 | Tepper | 102/213 |
| 4,010,365 | 3/1977 | Meyers et al. | 244/3.16 |
| 4,753,169 | 6/1988 | Shores | 102/293 |

FOREIGN PATENT DOCUMENTS

| | | | |
|---|---|---|---|
| 0141010 | 5/1985 | European Pat. Off. . | |
| 369958 | 5/1990 | European Pat. Off. | 244/3.16 |
| 1193304 | 5/1970 | United Kingdom . | |
| 1514457 | 6/1978 | United Kingdom . | |
| 2107127 | 4/1983 | United Kingdom . | |
| 2207814 | 2/1989 | United Kingdom . | |

*Primary Examiner*—Charles T. Jordan
*Attorney, Agent, or Firm*—Oliff & Berridge

[57] ABSTRACT

The invention relates to a protective cover which is complementary in shape to and is mounted on a sensing head such as that of a missile.

The protective device performs a dual function in that it is resistant to abrasion by impacting material such as dust, sand or ice, while at the same time being transparent to incident electromagnetic radiation which the sensing head is adapted to sense. The protective device may be moulded from a thin sheet (0.2 mm thick) of polytetra-fluoroethylene when this radiation is infrared.

11 Claims, 4 Drawing Sheets

PROTECTIVE DEVICE

The invention relates to a protective device, particularly for protecting the tip of a member.

Modern weapons often include a sensing head which senses a physical parameter of the target, for example its infrared emission and process the information from the sensing head to direct a missile so as to destroy the target. Such missiles may be fired from a vehicle such as a tank or aircraft and may be carried on that vehicle for a considerable time. The sensing head may be on the vehicle or on the missile itself. In some environments, the sensing head may become damaged, for example by passage through an abrasive atmosphere. If the sensing head becomes damaged or unevenly worn, its sensing properties may be impaired.

It is an object of the invention to seek to mitigate this disadvantage.

According to the invention there is provided according to a first aspect of the invention a protective cover for a sensing head which is sensitive to incident electromagnetic energy, comprising a material which is transparent to incident electromagnetic energy to which the sensing head is responsive.

The cover may be disposable, or replaceable.

Preferably the cover may comprise a film of polyethylene moulded to conform to the outer configuration of the sensing head.

The film may comprise polytetra-fluoroethylene.

This is particularly applicable to infrared radiations in the 1–12 micron waveband and is particularly transparent to incident radiation and is particularly lacking in friction with respect to an abrasive environment.

The film may be moulded to a desired contour in a heated mould defining the shape, and then cooled, and the film on removal from the mould may comprise a generally cigar-shaped article arranged with one part overlapping another.

The protective cover may have resilient means for mounting on and gripping a sensing-head.

The resilient means may comprise inherent resilience of the material of the cover.

The cover may include auxiliary means for securing the cover to a sensing head.

The protective cover may be substantially hemispherical.

According to a second aspect of the invention there may be provided a missile or other flying device having a nose incorporating a sensing head which may be sensitive to incident electromagnetic radiation, including, mounted on the sensing head a protective cover as hereinbefore defined.

A protective cover exbodying the invention is hereinafter described, by way of example, with reference to the accompanying drawings.

Figure 1:
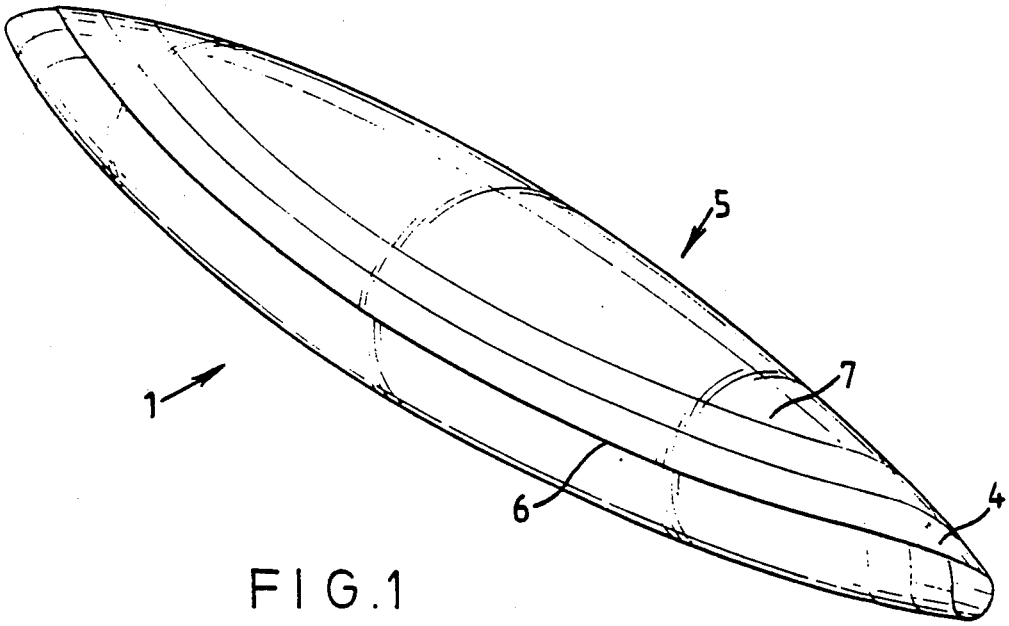
FIG. 1 is a perspective view of a protective cover according to the invention, after it is removed from a mould.
Figure 2:
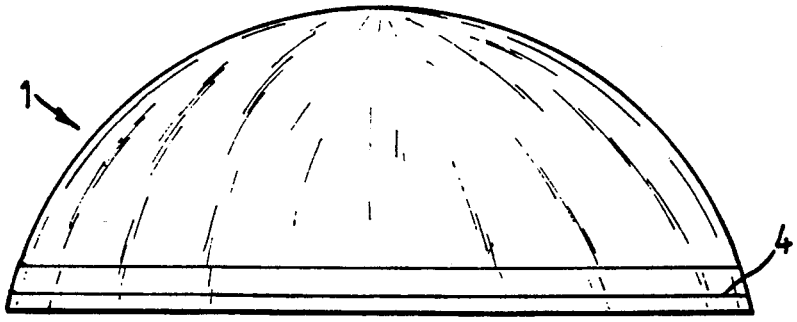
FIG. 2 is a side elevational view of the protective cover of FIG. 1, opened out to the shape it assumes in use.
Figure 3:
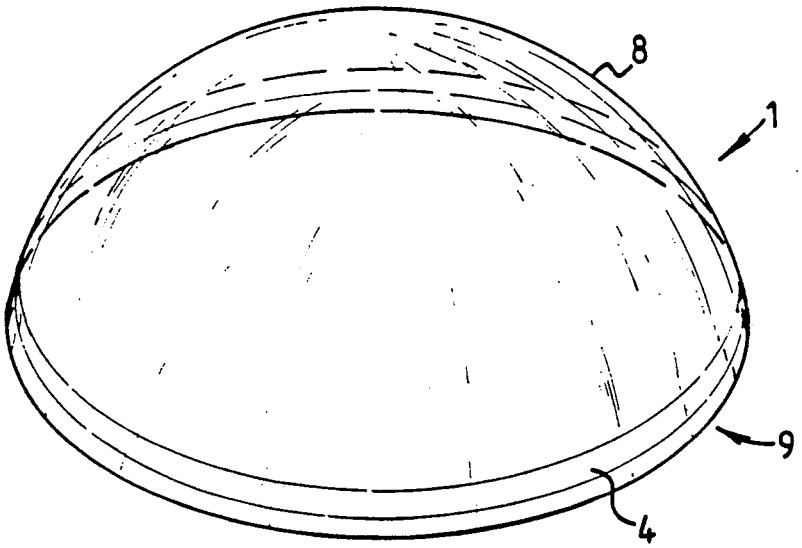
FIG. 3 is a perspective view of the protective cover of FIG. 2.

Referring to the drawings, there is shown a protective cover 1 for a sensing head 2 which is sensitive to incident electromagnetic energy, comprising a material which is transparent to incident electromagnetic energy to which the sensing head is responsive.

Figure 4:
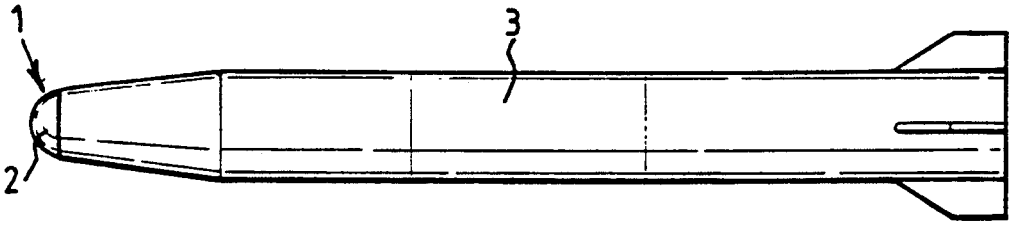
FIG. 4 shows a missile incorporating a protective device of FIGS. 1, 2 and 3.
Figure 5:
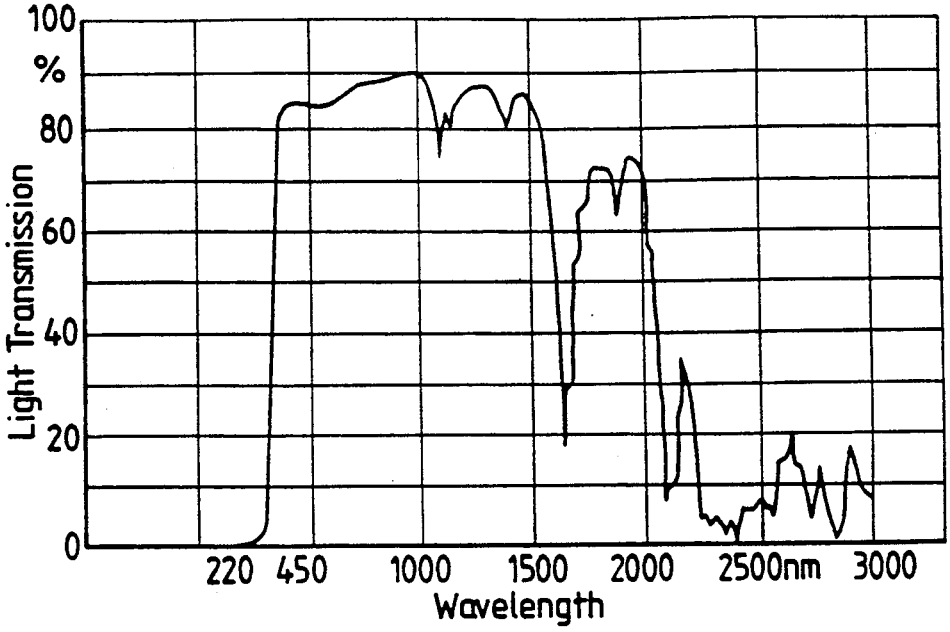
FIG. 5 is a graph of wavelength against light transmission through the protective cover of FIGS. 1 to 4.
Figure 6:
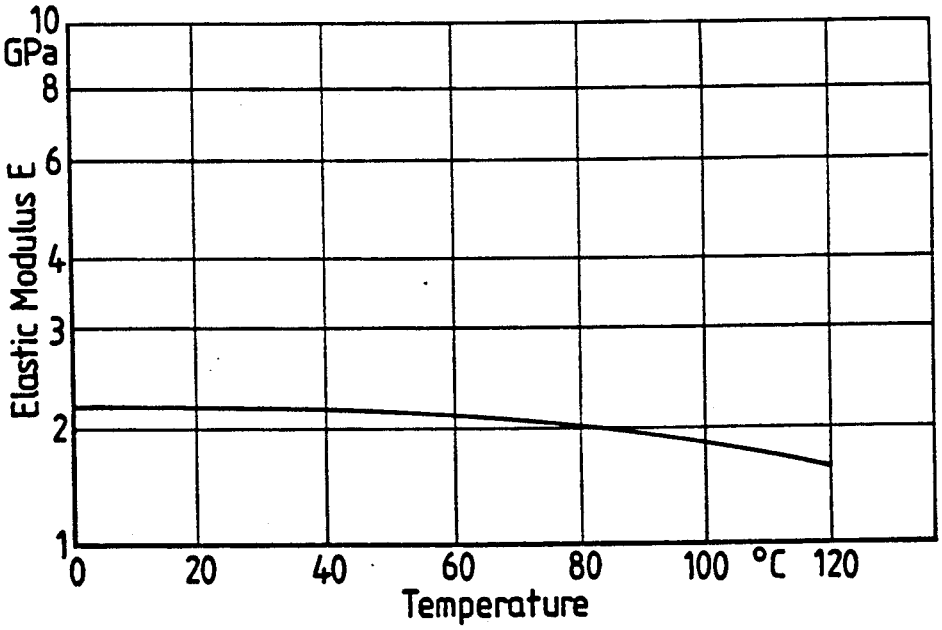
FIG. 6 is a graph of elastic modulus versus temperature for the material of the protective cap of FIGS. 1 to 4.
Figure 7:
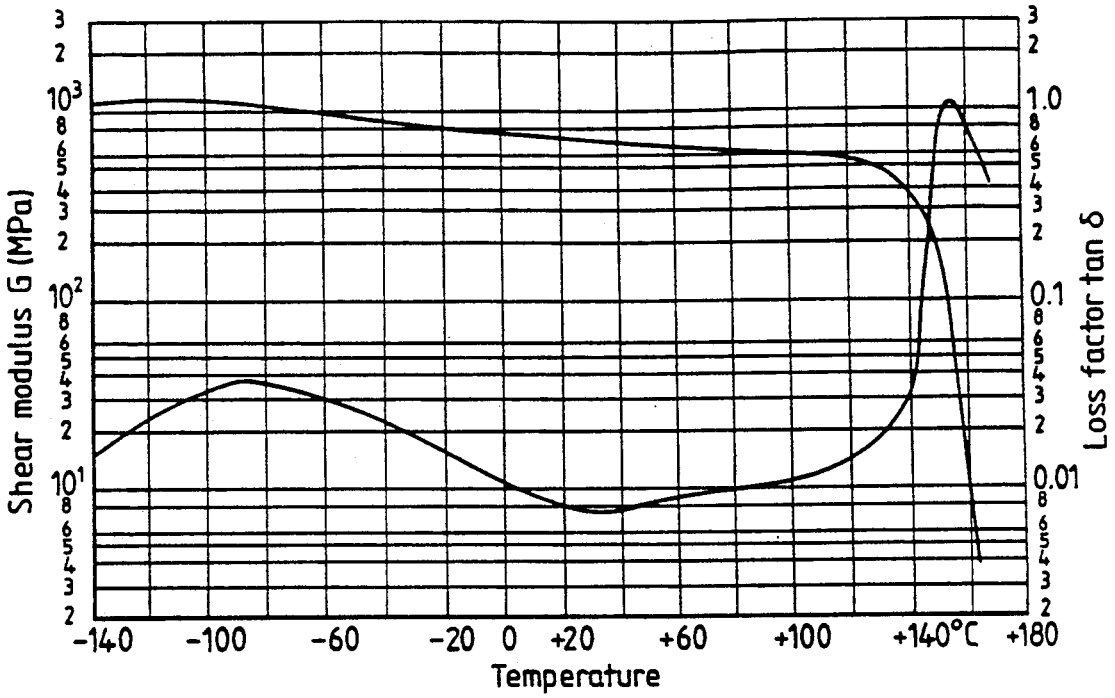
FIG. 7 is a graph of shear modulus and loss tan δ factor as a function of temperature.
Figure 8:
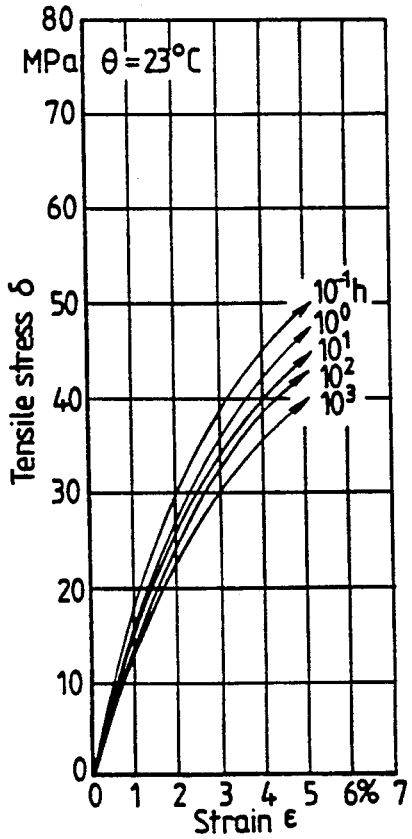
FIG. 8 is a graph of tensile creep test.

The protective cover 1 is a sheet of polytetra-fluoroethylene when the sensing head is responsive to electromagnetic radiation in the infrared range. The protective cover 1 is transparent optically, and is flexible and hemispherical in the embodiment so that it can be mounted on the complementary-shaped sensing head 2 of say a missile 3 (FIG. 4).

The protective cover 1 is moulded from a flat sheet of polytetra-fluoroethylene which is placed between male and female moulds, the edge of the sheet being gripped therebetween when the male and female moulds are brought together, and providing a slight surface impression or band 4 in the finished cover 1.

There is a slight vacuum applied to the mould cavity to ensure the concave shape required in the finished protective cover 1 and the mould is then heated to soften the sheet and form it to the concave shape required. Heating is for a few seconds only and then heating is ceased and the mould is allowed to cool for a few seconds, whereafter the mould is opened by separating the male and female mould parts. The protective cover 1 is removed from its male mould part, when the cover 1 springs round itself to form an elongate cigar-shaped article 5 as shown in FIG. 1, one diametrically opposed part 6 overlapping another 7. The protective cover 1 is packed in a heated sealed envelope (not shown) of plastic, and transported and stored in this condition.

On site, in use, the article 5 removed from its envelope, unrolled, and applied directly to the sensing head 2, on which it stays mounted owing to inherent resilience and friction.

The moulding process provides a smooth external 8 (convex) and internal 9 (concave) surface which respectively provide for a close fit of the protective cover 1 in complementary fashion over the sensing head 2. Moreover, the smooth external surface 8 and thickness (0.2 mm) of the protective cover ensures sensitivity to the flight characteristics of the missile 3 so that the missile flies true. Moreover, the force of the air in flight presses the protective cover 1 onto the sensing head 2, so it is not dislodged therefrom during flight. The protective cover 1 is thus able to perform its dual function, which is to protect the sensing head by deflecting any abrasive material such as dust, sand, ice particles which might be encountered during flight or whilst on the ground, the protective cover 1 being resistant to damage by impact of abrasive articles. At the same time, the material of the protective cover allows penetration without absorption or reflection of incident electromagnetic energy.

It will be understood that the protective cover 1 can be mounted on the sensing head for protection whilst on the ground. The protective cover 1 being inexpensive can readily be replaced.

It will also be understood that auxiliary means (not shown) for securing the protective cover on the sensing member may be utilized. These means may be tapes such as tie tapes or adhesive strips mounted on the protective cover adjacent the periphery thereof.

Also, it will be understood that the protective cover 1 illustrated herein is only one shape of a possible plurality or range of shapes, each one appropriate for mounting on a particular shape of sensing member. It will also be understood that there will be a plurality of moulds, each one for use in making a particular shape of protective cover 1 dedicated to a particular shape of sensing head 2.

The characteristics of material used for the protective cover are shown in the following Table, and particular characteristics are shown graphically in FIGS. 5 to 8.

TABLE

| Properties | Unit | Guide data | Test specifications |
|---|---|---|---|
| Density $\rho$ | g/cm$^3$ | 1.20 | ISO/R 1183<br>DIN 53479 |
| Tensile strength at break $\sigma_R$ | N/mm$^2$ | approx. 60 | ISO 1184<br>DIN 53455 |
| Elongation at break $\epsilon_R$ | % | approx. 100 | ISO 1184<br>DIN 53455 |
| Tensile modulus E, | N/mm$^2$ | >2100 | ISO 1184<br>DIN 53457 |
| Long-term service temperature (50% reduction in elongation at break) | °C. | 130 | DIN VDE 0304, Part 2 |
| Low-temperature resistance | °C. | −100 | |
| Water absorption | % | 0.5 | DIN 53495 Method 1.L.60 |
| Light transmission | % | >80 | DIN 5035<br>DIN 5036 |
| Dielectric strength[1] $E_d$ (50 Hz under oil, ball electrodes) | kV/mm | 60 | DIN 53481<br>VDE 0303, Part 2 |
| Volume resistivity $\rho_D$ | $\Omega \cdot$ cm | $10^{17}$ | DIN 53482<br>VDE 0303, Part 3 |
| Dielectric constant $\epsilon$ | | | IEC 250 |
| dry at 50 Hz | | 3.0 | DIN 53483 |
| 1 k Hz | | 3.0 | VDE 0303, |
| 1 M Hz | | 2.9 | Part 4 |
| Dissipation factor tan $\delta \cdot 10^3$ | | | IEC 250 |
| dry at 50 Hz | | 1 | DIN 53483 |
| 1 k Hz | | 1 | VDE 0303, |
| 1 M Hz | | 10 | Part 4 |
| Electrolytic corrosion | Stufe | A 1 | IEC 426<br>DIN 53489<br>VDE 0303, Part 6 |
| Coefficient of linear thermal expansion $\alpha$ | $10^{-6} \cdot K^{-1}$ | 80 | DIN 53752<br>VDE 0304, Part 1 |
| Fire performance: small burner[1] | | K3/F3 | DIN 53438 |
| Fire performance of materials used in automotive interiors[1] | | passed | MVSS 302 |

[1]Film thickness = 0.2 mm

I claim:

1. A protective cover for a sensing head having an external convex surface and which is sensitive to electromagnetic energy, wherein the cover comprises a flexible plastic sheet material transparent to incident electromagnetic energy to which the sensing head is responsive, and inherently resilient to achieve close-fitting contact with said sensing head, said sheet material having a concave surface complementary in shape to said external convex surface of said sensing head, whereby, in use, said convex surface and said concave surface engage one another.

2. A protective cover as defined in claim 1, wherein said cover is disposable.

3. A protective cover as defined in claim 1, wherein said cover comprises a film of a polyethylene moulded to conform to the external convex surface of the sensing head.

4. A protective cover as defined in claim 1, wherein the film comprises polytetra-fluoroethylene.

5. A protective cover as defined in claim 1, wherein the cover comprises a generally cigar-shaped article arranged with one part overlapping another.

6. A protective cover as defined in claim 5, wherein there is auxiliary means for securing the cover to a sensing head.

7. A protective cover as defined in claim 1, which is substantially hemispherical.

8. A protective cover as defined in claim 1, wherein said cover comprises a film molded to a contour in a heated mold defining the contour and then cooled.

9. A protective cover as defined in claim 1, wherein said cover is mounted on the sensing head of a flying device.

10. A protective cover as defined in claim 9, wherein said flying device is a missile.

11. A protective cover as defined in claim 1, wherein said convex surface has a surface area and said concave surface has a surface area, said convex and concave surfaces being in contact over substantially their whole surface areas.

* * * * *